United States Patent [19]

Chatkis

[11] Patent Number: 4,828,528

[45] Date of Patent: May 9, 1989

[54] GROWING DOLL

[76] Inventor: Jacob Chatkis, 4501 Fountain Rd., Unit 104, Lake Worth, Fla. 33467

[21] Appl. No.: 172,361

[22] Filed: Mar. 24, 1988

[51] Int. Cl.[4] ..... A63H 3/36; A63H 3/20

[52] U.S. Cl. ..... 446/320; 446/330

[58] Field of Search ..... 446/69, 72, 74, 79, 446/80, 220, 223, 226, 221, 268, 295, 320, 330

[56] References Cited

U.S. PATENT DOCUMENTS

| | | | |
|---|---|---|---|
| 3,091,053 | 5/1963 | Growald | 446/320 |
| 3,238,599 | 3/1966 | Bauman | 446/320 |
| 3,828,467 | 8/1974 | Kaelin | 446/320 |
| 4,622,021 | 11/1986 | Darrigo, Sr. | 446/320 |
| 4,685,893 | 8/1987 | Perkitny et al. | 446/320 |

FOREIGN PATENT DOCUMENTS

| | | | |
|---|---|---|---|
| 2041771 | 9/1980 | United Kingdom | 446/320 |

*Primary Examiner*—Robert A. Hafer
*Assistant Examiner*—Michael Brown
*Attorney, Agent, or Firm*—Leroy G. Sinn

[57] ABSTRACT

A doll is provided which has a stretchable inner liner, an expandable core within the inner liner and a skin layer in intimate contact with the inner liner. The inner liner has one or more growth phase means which can be a series of essentially parallel stitchings optionally joined by bridging loops. The growth phases can be simply activated at predetermined times by externally accessible means or by an internal winding device which can be caused to rotate from an external location of the doll.

14 Claims, 6 Drawing Sheets

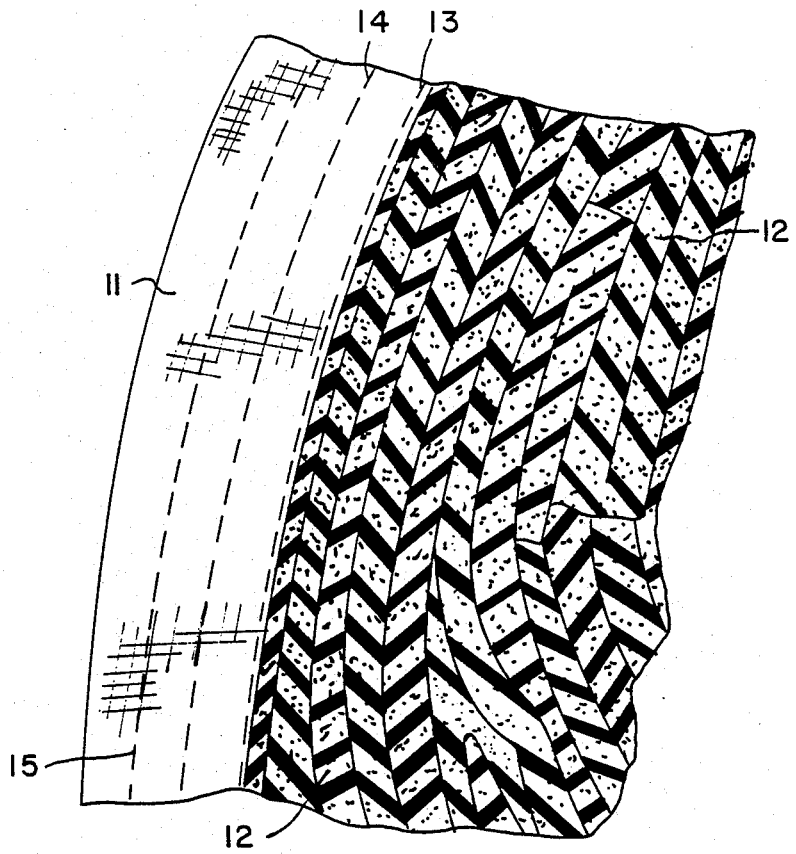
FIG. 7A-A
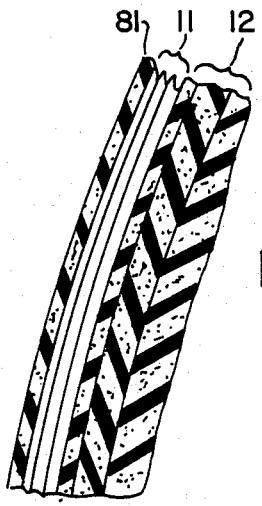
FIG. 8

GROWING DOLL

FIELD OF THE INVENTION

This invention relates to a novel growing doll, which can be made to grow simply to larger sizes to preselected extents in phases, for example, in phases when the child itself grows.

BACKGROUND ART

As a child becomes older and grows, it is desirable that the child's doll also can grow. In the past, doll devices which had the capability of growing involved quite complicated and cumbersome mechanisms. What is desired is to provide a simple and economical means by which a child's doll to which the child has been emotionally attached can be caused to grow in phases as desired.

SUMMARY OF THE INVENTION

By this invention is provided a novel growing doll which can be activated to grow simply and which can be made economically without involvement of cumbersome or complicated mechanisms. The doll comprises an inner liner which contains an expandable core, which causes the doll to expand or grow when the next growth phase is activated. The inner liner is stretchable and has a series of two or more growth phase means such as stitchings which successively permit, when removed or otherwise activated, the doll to grow to the pre-determined extent of the next growth phase. The inner liner can be made, for example, by taking a stretchable, flattened bag designed to take the contoured shape of the doll and sewing a series of stitchings spaced outwardly from a line inward from the periphery of the bag in an essentially parallel manner to prescribe a larger and larger liner. The inner liner is devised so that the respective stitchings can be activated successively so as to realize successive growth phases. The stitchings successively feed to the next stitching through an intermediate loop or bridging means, which prevents a next growth phase to be activated earlier than desired. The bridging means can be a loop of loose thread which can be a continuation of the thread forming the stitchings of the first growth phases. Regarding the type stitch, it has been found, for example, that a chain stitch is suitable. Other stitchings will be suggested to those skilled in the art.

The inner liner then is enclosed with a stretchable bag or layer which is the skin layer of the completed doll and is in intimate contact with the inner liner.

Means is provided so that a growth phase can be obtained in the fully composed doll from an exterior location of the doll to activate the most inner of the growth phase stitchings or other growth phase means to permit the next growth phase. This can be accomplished as by manually pulling the thread of the first growth phase until the first phase of growth is achieved. It is preferred that a bridging means or loop connect a growth phase stitching with the successive growth phase stitching so that its successive growth phase does not commence until the growth is desired. Means to monitor the end of a growth phase is incorporated into the end of a growth phase means or in the bridging means or connecting loop, such as for example, a color coding in the thread to alert one that the first growth phase is complete. Also, a resistance device can be incorporated into the line of the loop thread to alert one that the first growth phase has been completed. For example, a compressible ball can be incorporated into the line of the loop thread to so function. The thread can be fed through the opening of a tube of appropriate size which causes resistance to the passage of a compressible and resilient ball but is sufficiently large to permit it to pass, thereby indicating to one that the first growth phase has been completed. Further successive growth phases can in like manner be monitored.

The thread of the growth stitching can be pulled manually from an aperture in the skin layer or the thread can be wound upon a reel affixed in the interior of the doll body such as on a shaft having an exteriorly positioned knob to permit winding the thread without disturbing the skin layer or the shaft can be driven by a small electric motor which is battery operated to wind the thread of a growth stitching in effecting a growth phase. Appropriate alerts are desirably incorporated to apprise one when a growth phase is completed or when a growth phase activation is approaching.

The outer layer is made of material which is stretchable to permit expansion to the next growth phase. The material selected should provide an acceptable appearance and feel to the child.

BRIEF DESCRIPTION OF THE DRAWINGS

FIG. 7 is partial sectional view of the cross-section A—A of FIG. 1. It shows the expandable core of the inner liner in contact with the wall of the inner liner and shows also two successive growth phase stitchings and a final stitching, which permanently maintains the integrity of the inner liner.

FIG. 8 is a partial sectional view of a cross section through the skin and inner liner layers of the doll showing the respective layers to be in intimate contact with each other and the expandable core to be in intimate contact with the inner liner.

DETAILED DESCRIPTION OF THE INVENTION

Figure 1:
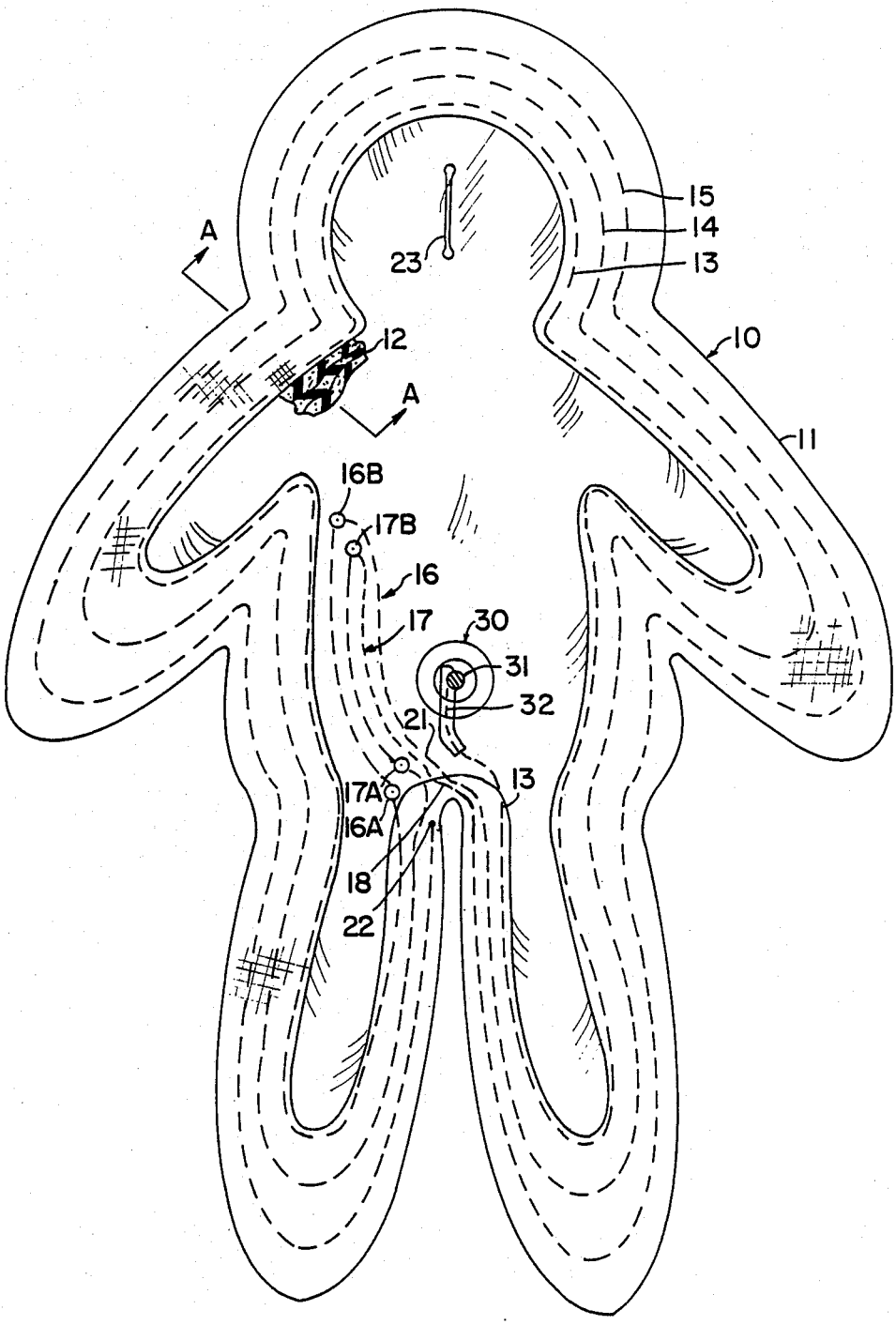
FIG. 1 is a perspective front view showing an inner liner for a growing doll having two growth phase stitchings to permit two successive phases of growth. A partial cutaway section shows an interiorly located winding device designed to take up the thread of the growth phase stitching to permit a next desired growth phase. The section as expanded is shown in FIG. 4. Also shown is section A—A taken through a cutaway portion to show the core of the inner liner, which is expandable so that growth phases can be provided (shown as FIG. 7).

Referring now to FIG. 1, a complete inner liner 10 includes an inner liner layer 11 made of a material suitable to enclose the expandable core 12, which has been placed within the inner liner layer 11. The expandable core material can be any material which is expandable and maintains an intimate contact with the inner liner so that it also maintains intimate contact with the expandable skin layer 81 as shown in FIG. 8. The growth phase stitchings are shown as first growth phase 13 and second growth phase 14. Stitching 15 permanently holds together the two sheets of material used to form the inner liner 10.

The growth phase stitchings can optionally be sewn through folds or pleats in the inner liner 10 so that when the growth phase stitchings are activated, the fold or pleat will be removed, resulting also in an enlargement of the inner liner and resultant doll growth.

The growth phase means can use any suitable stitch such as a chain stitch or other suitable means which upon activation permit the inner liner to grow to the first growth phase. The thread of the stitching must have adequate strength and flexibility to function. The beginning of growth stitching 13 is affixed to the reel 31 of the winding device 30 and continues circumferentially around the inner liner 10 terminating at alert ball 16A. Alert ball 16A is the beginning of bridging loop 16, which bridges first growth phase stitching 13 with second growth phase stitching 14. Bridging loop 16 has a second alert ball 16B. Bridging loop 16 ends at point 21, which is the beginning of the second growth phase stitching 14. Ball 16A is an alert means to inform one as it contacts the opening to lead tube 32 that the first growth phase is complete, that the growth phase stitching has ended and that the stitching thread has merged into the bridge loop 16 which connects the first growth phase stitching 13 and second growth phase stitching 14. Alert ball 17A is the beginning of bridging loop 17, which bridges second growth phase stitching 14 with permanent inner liner-forming stitching 15. If desired, bridging loop 17 can be eliminated and growth phase stitching 14 can be terminated at the point it merges into bridging loop 17. Second growth phase stitching 14 runs circumferentially around the inner liner 10 in generally parallel direction to stitching 13 and terminates in a bridging loop 17 which connects the second growth stitching 14 with permanent stitching 15. Bridging loop 17 commences with alert ball 17A and terminates with point 18. The stitching at point 18 is rendered permanent by conventional means such as cross-stitching. Bridging loop 17 has a second alert ball 17B to inform one that stitching removal is essentially complete.

Figure 2:
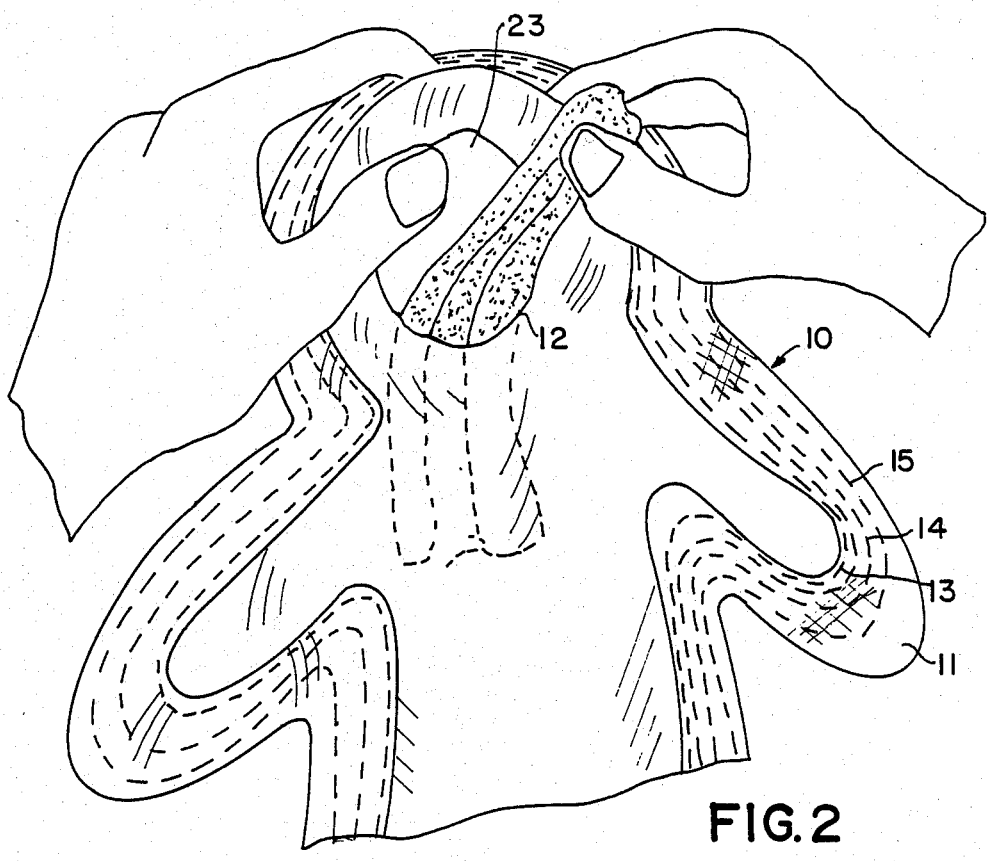
FIG. 2 is an elevational and partial sectional front view showing a manual stuffing through a slit of the inner liner (shown in FIG. 1) to form the expandable core of the inner liner.
Figure 3:
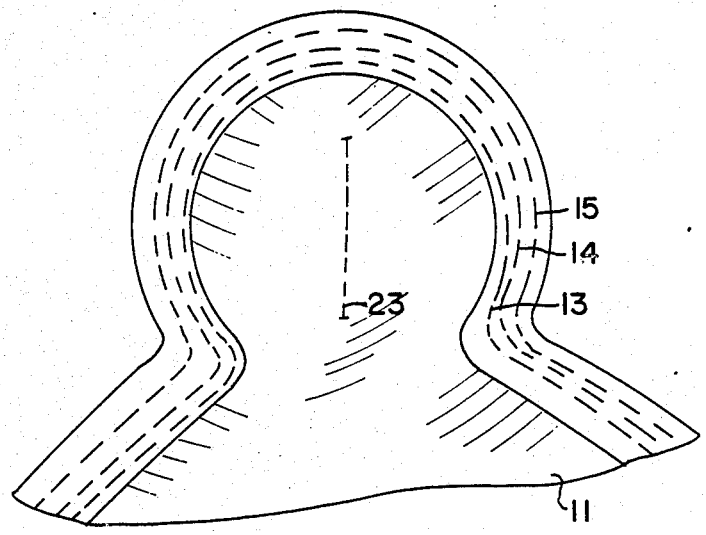
FIG. 3 is a perspective and partial front view showing the upper part of the inner liner stuffed to form the expandable core. The stuffing slit through which the stuffing was introduced into the inner liner to form the expandable core, is shown to be closed as by lacing.

Slot 23 is shown. The liner liner 10 can be stuffed with the expandable core 12 material by manually stuffing the core 12 material through slot 23 as shown in FIG. 2. FIG. 3 shows that slot 23 has been closed after stuffing as by lacing or stitching.

The expandable core 12 can also be formed by expandable material shaped in the final contour of the doll, either as one part or as multiple parts, such as separate core parts filling the legs, arms, body and head, respectively. The pre-shaped core either as a single part or as multiple parts, must be compressed to such extent that when the respective growth phase stitchings or other growth means are activated, that the doll will grow to the extent permitted by the next growth phase stitching or other means.

Figure 4:
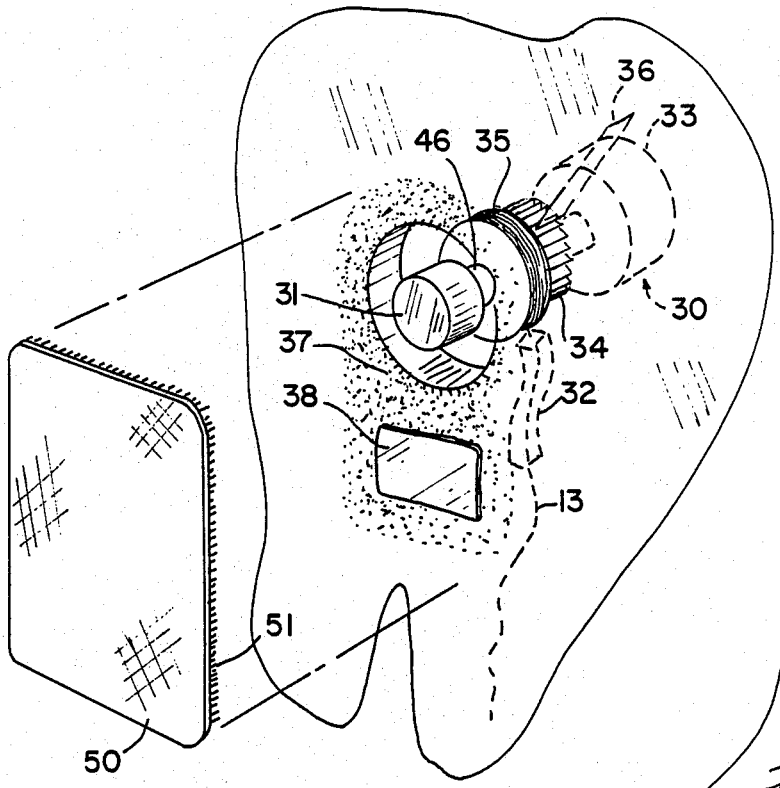
FIG. 4 is an elevational and partial sectional view of the winding device section of FIG. 1, which winds the stitching thread of a growth phase onto a reel mounted on a shaft. To the innermost end of the shaft is attached a small, battery-driven electric motor. The outer end of the shaft has a turning knob by which, if desired, the shaft can be rotated manually to cause successive removal of each growth phase stitching. A window is shown in the skin layer so that one can view the progress of a growth phase. A displaceable cover for the winding device is shown, whereby the winding device is securely covered to prevent premature activation of a growth phase. The cover can have a holding material on its surface which strongly but detachably adheres to a like holding material surface on the doll body exterior, which provides the base for the cover. Such a material is available under the Belco designation.

FIG. 4 shows the winding device 30 with its housing partially cut away. The winding device 30 is mounted so that an area of the skin layer and the inner liner layer 11 are joined. Knob 31 is attached to the end of shaft 32. Knob 31 also when depressed, successively activates the switch by which the motor 33 is turned on and off. Knob 31 also can be turned in a clockwise direction to manually wind the growth phase stitching thread upon reel 35. At the inner end of the shaft is located a battery-driven electric motor 33. The motor is capable of rotating the shaft 32 in a clockwise direction to wind the growth phase stitching thread. On the shaft also is affixed a sprocket 34 adjacent to the winding reel 35. Coordinating with sprocket 34 is pall 36, which engages with sprocket 34 to prevent the winding reel 35 to reverse direction, thereby preventing the wound growth stitching thread from unwinding. Shown is lead tube 32, which feeds the growth phase stitching thread to the path of reel 35. On the outer surface surrounding the recessed area in which the knob 31 is located is a holding material surface area 37 designed to receive cover 50, which has also a holding material surface area 51 designed to engage with surface area 37. Engagement of surface areas 37 and 51 causes cover 50 to adhere strongly although it can be removed such as by an adult when the next growth phase is desired. Transparent window 38 is shown by which the progress of the growth phase stitching thread as it is pulled and wound onto the winding reel 35, can be monitored.

Figure 5:
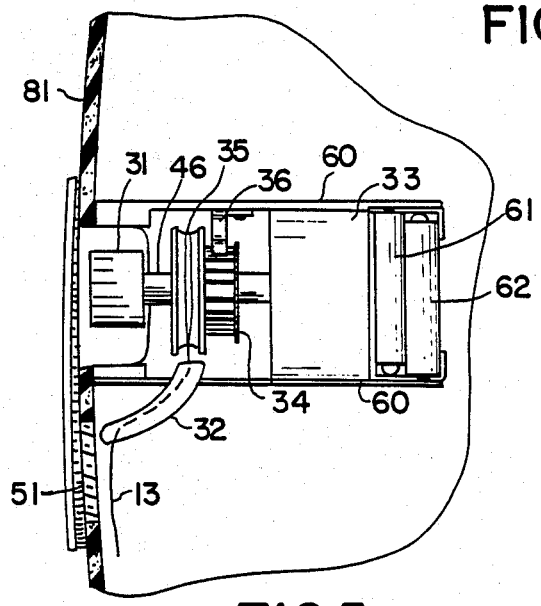
FIG. 5 is a sectional and elevational side view of the stitching winding device of FIG. 4.

FIG. 5 is a partially cutaway side elevational view of the winding device 30 as shown in FIG. 4. The winding device 30 is covered by housing 60. The winding reel 35 has two batteries 61 and 62 located at the end of the winding device 30 adjacent to the inner surface of the motor 33, which batteries are in electrical contact with motor 33. First growth phase stitching 13 thread is shown passing through lead tube 46 and being wound upon reel 35. Sprocket 34 is shown engaging with pall 36 to prevent a reversal of the shaft, which would permit unwinding of growth phase stitching thread 13. Knob 31 is shown attached to the end of shaft 32 by which the shaft can be turned or by which through depressing inwardly the motor 33 can successively be activated and inactivated. Cover 50 is shown in adhered or closed position covering knob 31 and window 38.

Figure 6:
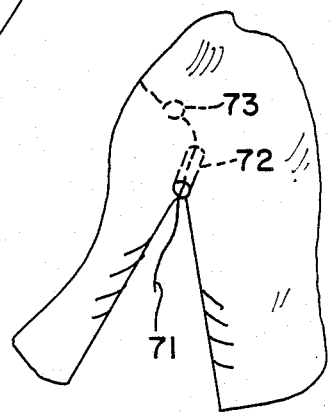
FIG. 6 is a sectional and elevational view of a doll body embodiment in which a growth phase stitching thread is shown being removed manually. In this embodiment, a growth phase stitching thread is removed by manually pulling the thread of a growth stitching through an aperture in the skin layer.

FIG. 6 is an elevational view showing an alternative embodiment by which growth phase stitching thread 71 is being removed manually by pulling through a lead tube 72, which leads the growth phase thread through the lead tube outside the doll body. An alert ball is shown which contacts lead tube 72, is compressed with an added pull and is drawn through the lead tube 72. Such alert balls are located as described in FIG. 1 in connection with the bridging loops so as to apprise one of the appearance of the end of a growth phase stitching and the approach of the next growth phase stitching.

Referring to FIG. 1, bridging loop 16 can optionally be joined to growth phase stitching 14 at the point it is shown to merge with bridging loop 17. Under this arrangement, the removal of growth phase stitching 14 will be in a generally clockwise direction or in a backtracking direction in relationship to the direction of removal of growth phase stitching 13.

Multiple growth phase stitchings which are not looped together can be employed, wherein the respective ends extend outside the doll body as shown in FIG. 6 with regard to growth phase stitching 71. In the use of multiple growth phase stitchings, the portions extending through lead tube 72 can be color coded to indicate order of activation of the respective growth phases.

FIG. 7 A—A is an expanded cross-sectional and partially cutaway view taken at A—A section of FIG. 1. First growth phase stitching 13, second growth phase stitching 14, and permanent stitching 15 are shown. The inner liner is made of material 11, which contains the expandable core 12.

FIG. 8 is a partial cross-sectional view taken through the skin layer 81, the inner liner layer 11 in intimate contact with the skin layer 81, and expandable core 12 being contained by inner liner 10.

Figure 9:
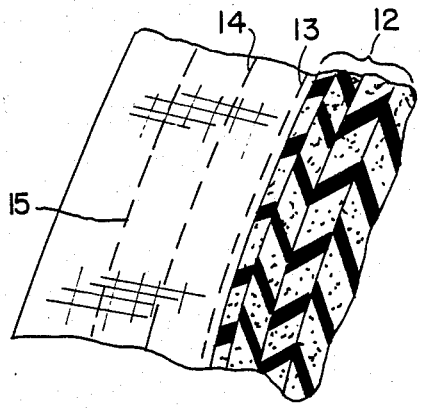
FIG. 9 is a partial sectional view as shown in FIG. 7 in which the growth phase stitchings are both in place.
Figure 10:
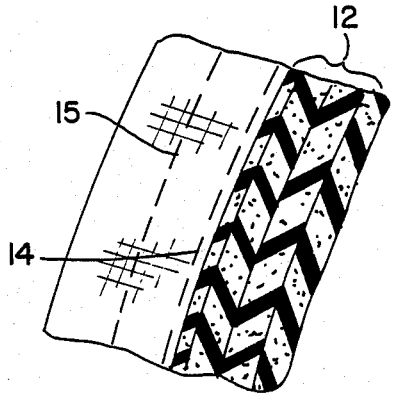
FIG. 10 is a partial sectional view of FIG. 9, after the first growth phase has been completed.
Figure 11:
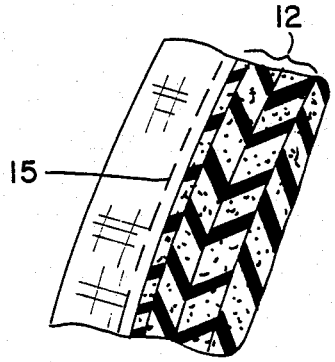
FIG. 11 is a partial sectional view as shown in FIG. 10, after the second growth phase has been completed.

FIGS. 9–11 are cross-sectional views taken through the growth phase stitchings 13 and 14, and permanent stitching 15 and a portion of contained expandable core 12 with a top portion of inner liner 10 cut away. FIG. 9 is a view showing both growth phase stitchings 13 and 14 unactivated; FIG. 10 shows that the first growth phase has been activated and completed; and FIG. 11 shows that the second growth phase has been activated and completed.

Figure 12A:
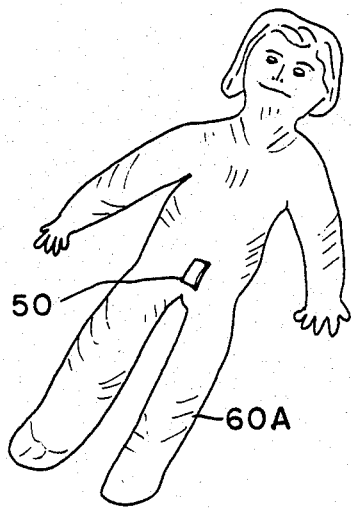
FIG. 12A is a front elevational view of a growing doll of the invention wherein the doll has its original size.
Figure 12B:
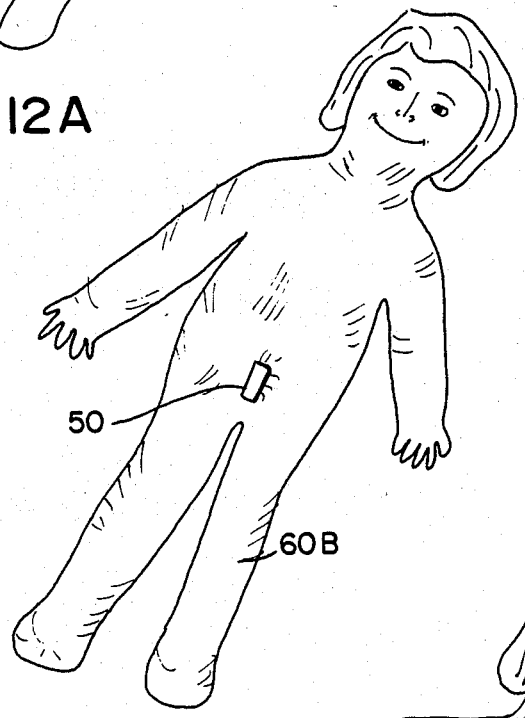
FIG. 12B is a front elevational view of the doll of FIG. 12A after completion of the first growth phase.
Figure 12C:
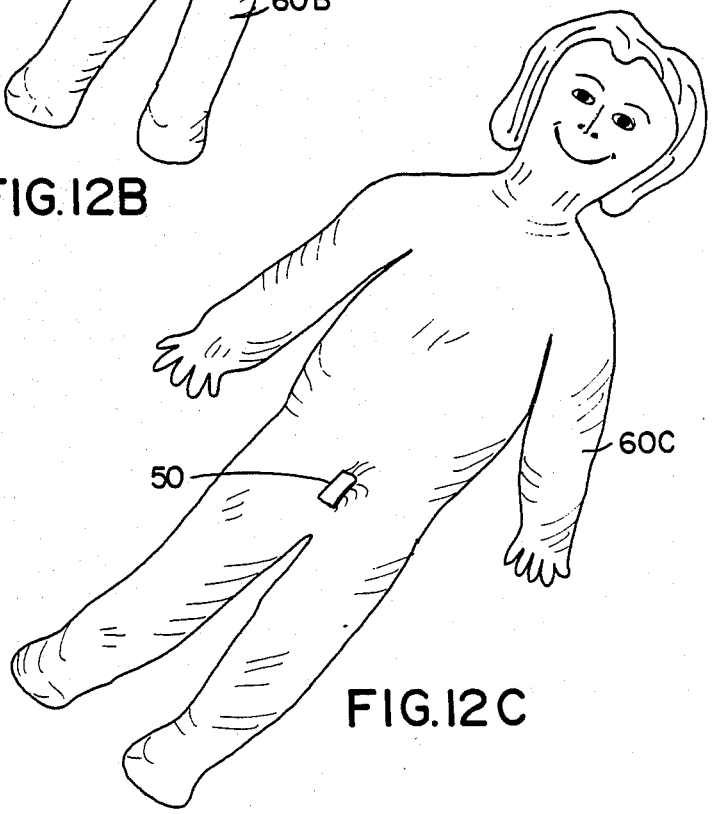
FIG. 12C is a front elevational view of the doll of FIG. 12A after completion of the second growth phase.

FIGS. 12A, 12B and 12C are elevational views of completed dolls 60A, 60B and 60C, somewhat reduced in size, having the inner liner 10 of FIG. 1 covered with stretchable skin layer 31. Doll 12A depicts the doll prior to activation of any growth phase, doll 12B is doll A after activation and completion of the first growth phase; and doll 12C is doll A after activation and completion of the second growth phase.

The growth phase stitching thread, referring to FIG. 1, is removed by use of the winding device 30, more fully shown in FIGS. 4 and 5. The growth phase stitching thread is fed into the winding device 30 through lead tube 32 which feeds the thread to be wound upon winding reel 35. The lead tube 32 is positioned in part behind transparent window 38 associated with the external skin layer 81 of the doll, as shown in FIG. 5.

In operation, referring further to FIGS. 1, 4 and 5, the doll as it is fully assembled as shown in FIG. 12A can be made to grow to its first growth phase. Knob 31 is turned clockwise or the knob 31 is depressed to activate the battery-driven motor 33, which drives shaft 46 to wind the growth phase stitching thread 13 upon reel 35. The first growth phase stitching 13 thread is fed into the winding device to be wound upon the winding reel 35, which is shown in detail in FIGS. 4 and 5. When the first growth phase stitching 13 thread is completely wound about the winding reel 35, the bridging loop 16 follows to be wound, beginning at alert ball 16A, a terminus of bridging loop 16. As the bridging loop 16 thread is wound upon the winding reel 35, the ball alert 16A will enter lead tube 32 and pass by window 46, shown in FIGS. 4 and 5. In order to pass through the lead tube 32, the alert ball 16A must be compressed slightly, which requires an additional noticeable force to urge forward the growth phase stitching thread for continued winding. The passage of the alert ball 16B can likewise be observed through window 46. When alert ball 16A reaches the mouth of the lead tube 32, the first growth phase stitching 13 thread has been completely removed, the expandable core 12 of the doll has expanded so that the doll has grown to the size as defined by second growth phase stitching 14. When alert ball 16B enters lead tube 32 and passes by the window 38, the activation of the second growth phase is approaching. Upon observing alert ball 16A, further winding should be ceased until it is desired to activate the second growth phase stitching 14, and, in like manner, the procedures and precautions should be followed for any subsequent growth phases in a growing doll of this invention.

The second growth phase can be accomplished again by winding the remainder of the bridging loop 16 into the winding device 30, including the second alert ball 16B. After the entire bridging loop 16 thread terminated by point 21 has been fed into the winding device, the second growth phase stitching 14 thread is fed into the winding device 30 as the reel 35 continues to rotate in a clockwise direction. When the entire second growth phase stitching 14 thread is wound upon reel 35, the alert ball 19A enters lead tube 32 and passes window 38. At this point, the winding device is inactivated. At the completion of the winding of the second growth phase stitching 14 thread, the doll has attained its second growth phase as prescribed by permanent stitching means 15.

It will be apparent to those skilled in the art that additional growth phases can be utilized and that other embodiments of the above described invention can be made which come within the spirit and scope of the invention.

What is claimed is:

1. A growing doll comprising in combination a stretchable inner liner, multiple layers of growth phase stitching which are positioned in a spaced and substantially parallel relationship around the perimeter of the inner liner, said multiple layers of growth phase stitching are sequentially activated by a pulling means at selected times to permit said inner liner to grow, a skin layer which covers said inner liner and is stretchable to permit the doll to expand, an expandable core which fills said inner liner so that the doll is urged to undergo the successive growth phases as the successive growth phase means are activated, and one or more bridging loops connecting said multiple layer of stitching growth phase means to prevent premature growth phase means activations.

2. A doll of claim 1 wherein the means of activation of said growth phase series is an internal winding device and said growth phase means are stitching, said winding device having a reel upon which said growth phase stitching thread is wound.

3. A doll of claim 2 wherein said winding device restrains said winding reel from reversing rotational directions.

4. A doll of claim 2 wherein said winding device is driven by an electric motor.

5. A doll or claim 2 wherein the winding device is capable of being manually driven by turning the end of the shaft of said winding device which end is accessible from an external location of the doll.

6. A doll of claim 1 wherein the growth phase means are capable of being activated manually.

7. A doll of claim 1 wherein one or more bridging loops have a warning means adapted to inform that a growth phase is complete.

8. A doll of claim 1 wherein the said growth phase means are capable of being activated manually and said growth phase means are stitchings.

9. A doll of claim 8 wherein the manual activation of said growth phase means is done by pulling the growth phase stitching thread through an aperture in the skin layer.

10. A doll of claim 1 wherein the growth phase means are stitchings.

11. A growing doll comprising in combination a stretchable inner liner, one or more growth phase stitchings which are positioned in a spaced and substantially parallel relationship around the perimeter of the inner liner, said growth phase stitchings are sequentially activated at selected times to permit said inner liner to expand, a skin layer which covers said inner liner and is stretchable to permit the doll to expand, an expandable core which fills said inner liner so that the doll is urged to expand to the next growth phase stitching as successive growth phase stitchings are activated, said growth phase stitchings being capable of activation by pulling the growth phase stitching thread through an aperture in the skin layer.

12. A doll of claim 11 wherein one or more of said growth phase stitchings have at the beginning or end a warning means adapted to inform that a growth phase is complete or approaching activation.

13. A doll of claim 12 wherein the growth phase stitchings are formed of chain stitches.

14. A doll of claim 11 wherein the growth phase stitchings are formed of chain stitches.

* * * * *